US009274481B2

(12) United States Patent
Takahashi

(10) Patent No.: US 9,274,481 B2
(45) Date of Patent: Mar. 1, 2016

(54) IMAGE FORMING APPARATUS

(75) Inventor: Kyosuke Takahashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 39 days.

(21) Appl. No.: 13/475,028

(22) Filed: May 18, 2012

(65) Prior Publication Data

US 2012/0301159 A1 Nov. 29, 2012

(30) Foreign Application Priority Data

May 25, 2011 (JP) ..... 2011-117427

(51) Int. Cl.
*G03G 15/08* (2006.01)
*G03G 15/00* (2006.01)
*G03G 15/01* (2006.01)

(52) U.S. Cl.
CPC ..... *G03G 15/5041* (2013.01); *G03G 15/0126* (2013.01); *G03G 15/0189* (2013.01); *G03G 2215/0129* (2013.01); *G03G 2215/0164* (2013.01)

(58) Field of Classification Search
CPC .. G03G 1/0126; G03G 1/556; G03G 1/50415
USPC ..... 399/27, 44, 49, 51, 55, 72
See application file for complete search history.

(56) References Cited

U.S. PATENT DOCUMENTS

2003/0091356 A1* 5/2003 Komatsu et al. ..... 399/49
2006/0159474 A1* 7/2006 Suzuki et al. ..... 399/27
2008/0025738 A1* 1/2008 Ahn et al. ..... 399/27
2008/0205923 A1* 8/2008 Takeuchi et al. ..... 399/62
2010/0040389 A1* 2/2010 Akatsu ..... 399/48

FOREIGN PATENT DOCUMENTS

JP 5-19630 A 1/1993
JP 6-282166 A 10/1994
JP H07-191533 A 7/1995
JP 9-127757 A 5/1997
JP 09146311 A * 6/1997
JP 3113561 B2 9/2000
JP 2005-99216 A 4/2005

OTHER PUBLICATIONS

JP 09-146311 English translation, Watanabe et al. Jun. 1997.*

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes an image bearing member on which an electrostatic latent image is formed, a developing device that develops the electrostatic latent image formed on the image bearing member by using developer, a temperature detecting portion that detects information regarding the temperature of the developer in the developing device, and a density detecting portion that detects the density of a control image formed on the image bearing member. In addition, a controller controls the amount of the developer supplied to the developing device based on the detection result of the density of the control image, and a change portion changes an electric potential difference between an electric potential of the electrostatic latent image of the control image and a DC bias applied to the developing device so as to compensate for changing developing efficiency caused by temperature, based on the detection result acquired by the temperature detecting portion.

4 Claims, 9 Drawing Sheets

IMAGE FORMING APPARATUS

BACKGROUND OF THE INVENTION

1. Field of the Invention

The present invention relates to an image forming apparatus of an electrophotographic type such as a printer or a copier.

2. Description of the Related Art

In image forming apparatuses of an electrophotographic type that form images by charging toner and using an electrostatic force, in a case where the amount of charged toner changes, the density or the quality of an output image changes according to the change. The amount of charged toner markedly changes according to the usage environment, the amount of consumption of toner, and an output elapse time. Accordingly, in a case where some kind of control operation for stabilizing the output is not performed, an output image varies depending on a variety of conditions.

In the case of the image forming apparatuses of the electrophotographic type, toner of almost the same amount as the amount of consumption of toner, which is predicted based on image data, is supplied. In addition, in the case of image forming apparatuses of the electrophotographic type using a two-component developing device that forms an image by using toner and a magnetic carrier as developer, generally, the toner supply amount is adjusted or limited using an output value of an inductance sensor that measures the density of toner in the developer.

In the two-component developing device, the amount of charged toner changes according to a mixing ratio of toner to a magnetic carrier contained inside the developing device. Generally, the lower the ratio of toner is, the larger the amount of the charged toner becomes. As the amount of charged toner increases, the amount of toner adhering to an electrostatic latent image having a constant amount of electric charge decreases. On the other hand, as the amount of charged toner decreases, the amount of toner adhering to an electrostatic latent image having a constant amount of electric charge increases. Accordingly, there is a problem in that the amount of charged toner and the density of an output image change based on the consumption and the supply of the toner.

In order to solve such a problem, as disclosed in Japanese Patent Laid-Open No. 09-127757, a patch image used for measuring the density of an output image is output to stabilize the density of the image. A technique has been proposed in which the toner supply amount is controlled to form the amount of charged toner, at which the density of the output image matches a target density, based on the density of the patch image that is measured on an image bearing member. According to such a technique, a mechanism is included which develops the patch image used for a control process and performs control such that a detection result of the density of the patch image is fed back to the toner supply amount.

Then, for a latent image of a predetermined patch image electric-potential, by controlling the toner supply amount such that the density of the patch image is constant, a T/D ratio that is the ratio between toner and the magnetic carrier contained in the two-component developer is changed. As a result, by performing control such that a density reference value of the patch image used for controlling the supply of toner and a read-out density value of the formed patch image match each other, the amount of the charged toner reaches a desired target amount of the charged toner. In other words, the amount of charged toner and the image density can be maintained to be constant through the feedback control of the supply of toner based on the formation of a patch image in a predetermined electric potential condition. However, the amount of charged toner is maintained to be constant only in a case where the developing efficiency does not change.

However, in a case where the toner supply amount is controlled based on the output result of the patch image as above, there may be a case where the action of forming the amount of charged toner to be a target value that is constant is interfered. In the electrophotography technique, since an image is formed by using an electrostatic force, the amount of charged toner can be unchanged. This problem will be described in detail as below.

In a control mechanism for stabilizing the density of the output image through adjusting the toner supply amount based on the output result of a patch image, the density of the patch image is measured to control various adjustments. Accordingly, when the filling ratio (hereinafter, referred to as a "developing efficiency") of charged toner for the development contrast changes according to the toner temperature, the density of the patch image changes even in a case where the amount of charged toner is the target value.

In other words, the characteristics of the toner surface change according to the toner temperature, and the toner parting properties between the toner and the magnetic carrier changes, whereby the developing efficiency changes so as to change the amount of development (the amount of loaded toner). Even in such a situation, the amount of supply of the toner is controlled such that the density of the patch image matches the target density, and accordingly, the amount of the charged toner deviates from the target value.

This will be described below in detail. As the density of the patch image, the amount of toner included in the patch image is determined based on the amount of reflected light. The amount of toner is proportional to the development contrast (an electric potential difference between the electric potential of an image portion and a developing bias (a DC bias applied to a developing sleeve)) and a developing efficiency (the filling ratio of charged toner for the development contrast) and is inversely proportional to the specific charge of toner (electric charge per unit mass of toner). In a case where the temperature does not change so as not to change the developing efficiency, the amount of charged toner (triboelectricity) can be estimated based on the density of the patch image. Accordingly, by controlling the supply of the toner so as to match the target density of the patch image, the amount of charged toner can be controlled to be the target value.

However, as illustrated in FIG. 6A, when the toner temperature rises, the developing efficiency decreases, and accordingly, when the same control process is performed also in a case where the developing efficiency changes due to a change in the toner temperature, the amount of the charged toner deviates from the target value. More specifically, in a case where the developing efficiency decreases, the density of the image decreases at the same specific charge of toner, and the specific charge of toner is determined to be high. Accordingly, the supply of toner is controlled so as to lower the specific charge of toner.

Therefore, even in a case where the amount of development of the toner (this is determined based on the density of the patch image) is optimized for an image bearing member, the amount of charged toner deviates from the target value, and there is a problem in that the process thereafter cannot be appropriately performed. For example, in order to perform a transfer appropriately, the amount of charged toner is insufficient or excessive, and there is a problem in that the density and the quality of the image are degraded.

Thus, the present invention aims for providing a developing device that can suppress variations in the amount of charged toner due to a change in the developing efficiency that is accompanied with the change in the temperature.

SUMMARY OF THE INVENTION

In order to achieve the above object, there is provided an image forming apparatus including an image bearing member on which an electrostatic latent image is formed, a developing device that develops the electrostatic latent image formed on the image bearing member by using developer, a temperature detecting portion that detects information regarding the temperature of the developer in the developing device, a density detecting portion that detects the density of a control image formed on the image bearing member, a controller that controls the amount of the developer supplied to the developing device based on the detection result of the density of the control image, and a change portion that changes an electric potential difference between an electric potential of an image portion at the time of forming the control image and a DC bias applied to the developing device based on the detection result acquired by the temperature detecting portion.

Further features of the present invention will become apparent from the following description of exemplary embodiments with reference to the attached drawings.

DESCRIPTION OF THE EMBODIMENTS

Hereinafter, an image forming apparatus according to exemplary embodiments of the present invention will be described with reference to the drawings.

First Embodiment

First, an overview of the image forming apparatus according to the present invention will be described with reference to FIGS. 1 to 6.

(Image Forming Apparatus)

Figure 1:
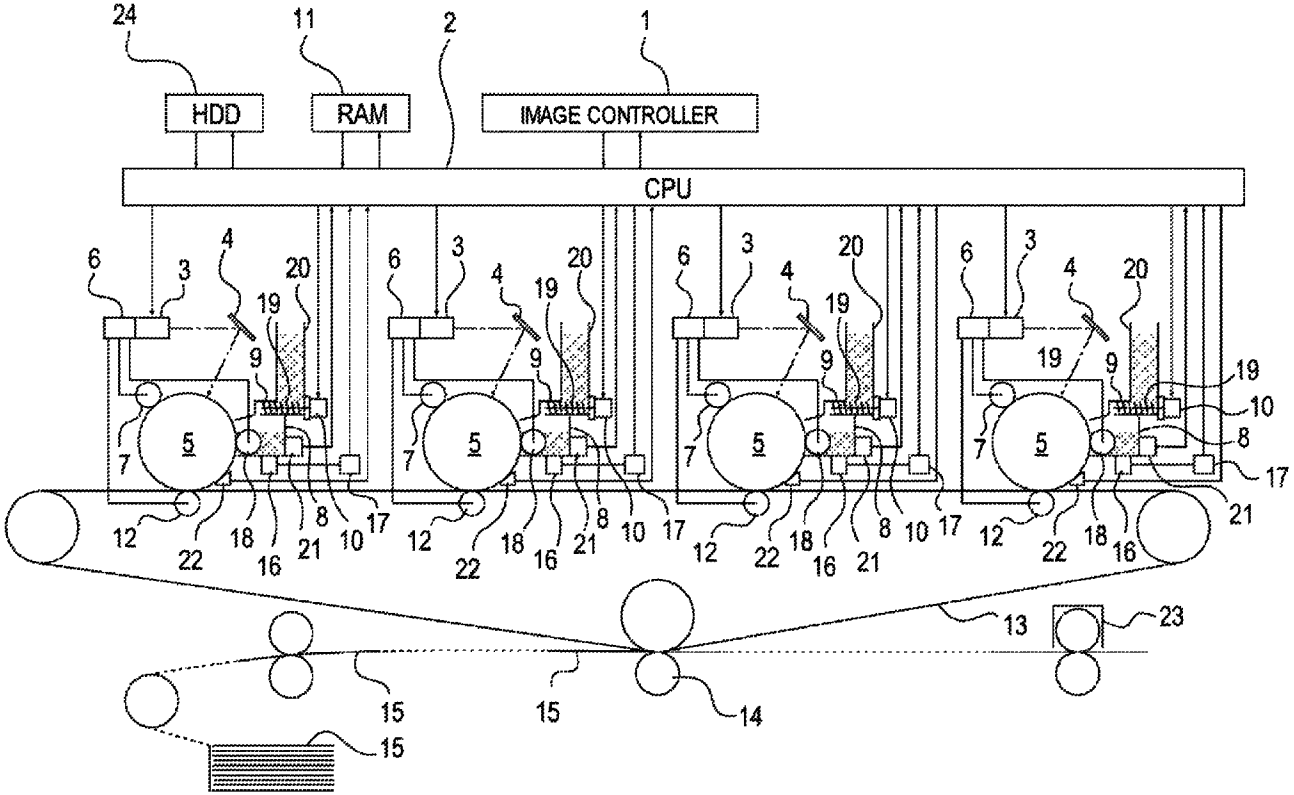
FIG. 1 is a schematic diagram illustrating the whole configuration of an image forming apparatus according to the present invention.

FIG. 1 illustrates the whole configuration of the image forming apparatus according to the present invention. In the image forming apparatus illustrated in FIG. 1, an image controller 1 receives an electrical signal representing image information described in a specific description language from a host computer that is not illustrated in the figure. After image forming data is generated, a central processing unit (CPU) 2 that controls the image forming apparatus performs signal processing used for a laser driver 3 of an image forming apparatus main body generating an electrostatic latent image and transmits a signal to the laser driver 3.

The laser driver 3 converts the electrical signal into an optical signal and emits the optical signal to a polygon mirror installed, which is not illustrated in the figure, rotating at a high speed. The optical signal reflected by the polygon mirror is emitted by a reflection mirror 4 to the surface (on the image bearing member) of a photosensitive drum 5 that serves as an image bearing member on which an electrostatic latent image corresponding to the image information is formed.

The photosensitive drum 5 is uniformly charged at a constant electric potential by a charging roller 7 that becomes a charging member according to a voltage value controlled by a high-voltage output portion 6 serving as a bias applying portion that is a high voltage power source, and the electric potential of an emission portion changes according to reception of light emission, whereby an electrostatic latent image is formed on the photosensitive drum 5. The laser driver 3 is configured as a latent image forming portion that forms an electrostatic latent image corresponding to an image information signal on the photosensitive drum 5 (on the image bearing member).

In the image forming apparatus according to this embodiment, the surface of the photosensitive drum is negatively charged, and the toner is negatively charged, whereby the toner is configured to adhere to a portion (bright portion) for which light emission is performed by the laser driver 3. In addition, since the surface of the photosensitive drum 5 is charged by using the charging roller 7 so as to be at a constant electric potential, the electric potential of the bright portion at which the toner is developed changes depending on the intensity of light emitted from a laser diode (LD: semiconductor laser). In other words, the toner developing amount can be adjusted by controlling the amount of light emission for the photosensitive drum 5.

(Developing Device)

A developing device 8 that develops an electrostatic latent image formed on the photosensitive drum 5 (on the image bearing member) by using charged toner as developer includes a developing container 9 that houses a developer containing toner and a magnetic carrier and a developing sleeve 18 that serves as a developer bearing member that carries the developer. Then, only the toner included in the developer is caused to adhere to the photosensitive drum 5 by the developing sleeve 18, and the electrostatic latent image formed on the photosensitive drum 5 is formed as a visible image as a toner image.

(Control Supply of Toner)

Regarding the toner in the developing container 9, a CPU 2 as a controller drives a toner supply motor 10 as is necessary so as to rotate a supply screw member 19, whereby the toner is supplied to the inside of the developing container 9 from a toner hopper 20 as is necessary. The CPU 2 stores the toner supply amount within a predetermined period in a random access memory (RAM) 11. A development bias voltage controlled by the high-voltage output portion 6 is applied to the developing sleeve 18.

After toner images of each color formed on the surface of the photosensitive drum 5 are transferred onto an intermediate transfer belt 13 by a primary transfer unit 12, the toner images are transferred further to the surface of a recording material 15 such as paper sheet by a secondary transfer unit 14.

Figure 3:
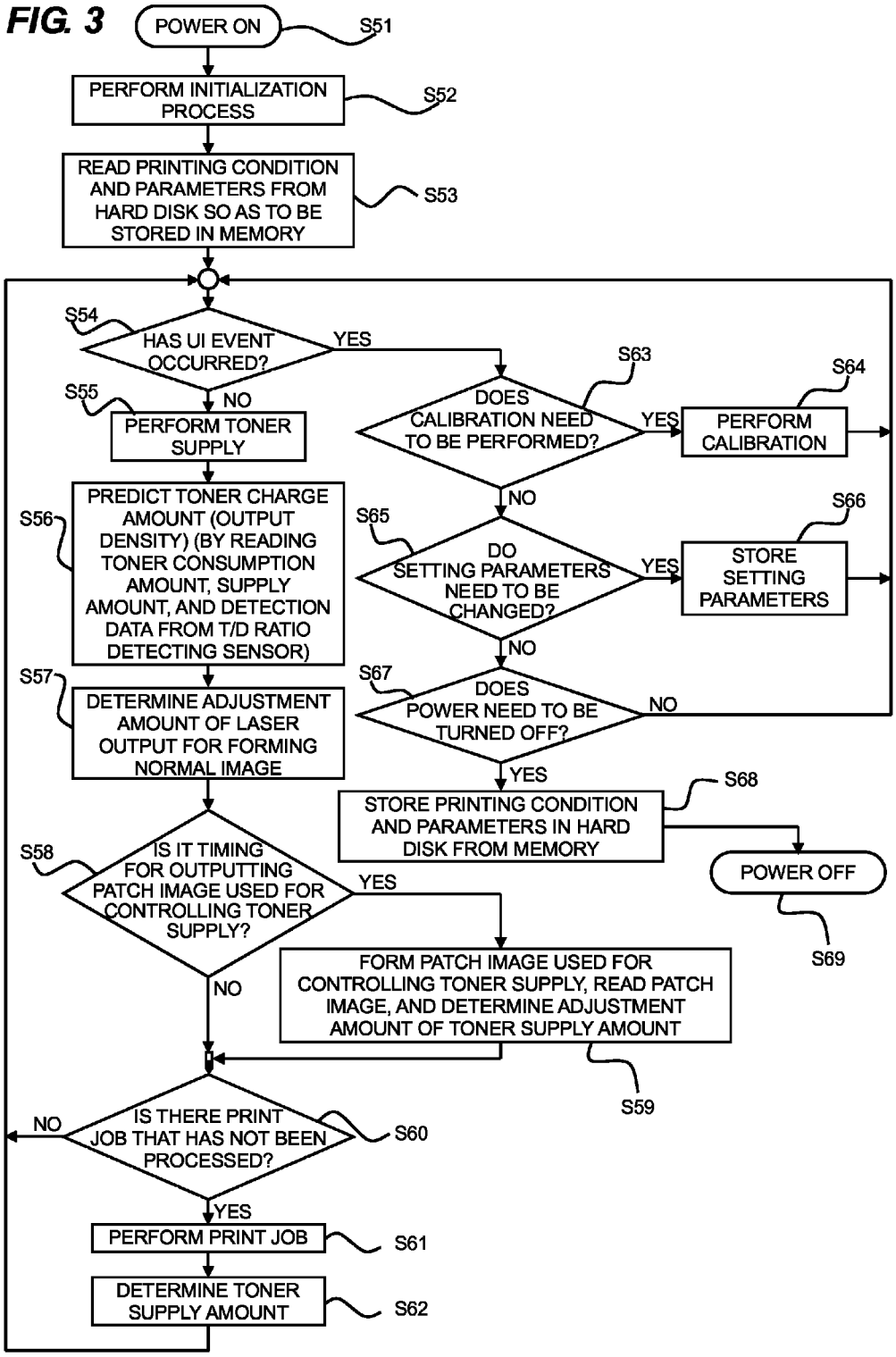
FIG. 3 is an operational flowchart of an image forming apparatus according to a first embodiment of the present invention.

FIG. 3 illustrates an operational flowchart of the image forming apparatus according to this embodiment. As illustrated in FIG. 3, when the power of the image forming apparatus is turned on in Step S51, an initialization process is performed in Step S52, and printing conditions and parameters are read from a hard disk drive (HDD) 24 so as to be stored in the RAM 11 serving as a memory in Step S53.

Then, in Step S54, it is determined whether or not a user interface (UI) event occurs which sets printing parameters according to user's various operations such as pressing a button or setting a document, which are performed for the image forming apparatus, or various operations such as a copying operation.

In a case where the UI event does not occur, the process proceeds to Step S55, and toner is supplied. Next, in Step S56, a toner consumption amount, a toner supply amount, and detection data supplied from a T/D ratio detecting sensor 16 are read so as to predict the toner charge amount (output density).

Next, in Step S57, a laser output adjustment amount of the laser driver 3 for forming a normal image is determined. Then, in Step S58, it is determined whether or not it is the output timing of a control image (hereinafter, referred to as a "patch image") used for controlling the supply of toner. When it is the output timing of a patch image, the process proceeds to Step S59, the patch image used for controlling the supply of toner is formed, the density of the patch image (control image density) is read out by an optical sensor 22 serving as a density detecting portion, and the toner supply adjustment amount is determined. The adjustment of the toner supply amount, which is performed in Step S59, illustrated in FIG. 3 will be described later in detail with reference to the flow illustrated in FIG. 5. In this embodiment, based on the detection result acquired by the optical sensor 22, in a case where the density of the patch image increases, the toner supply amount is decreased.

In a case where it is not the output timing of the patch image for controlling the supply of toner in Step S58 illustrated in FIG. 3 or after the toner supply adjustment amount is determined in Step S59, the process proceeds to Step S60, and it is determined whether or not there is a print job that has not been processed. In a case where there is a print job that has not been processed, the process proceeds to Step S61, and the print job is executed, and then, the toner supply amount corresponding to the amount of toner consumed in Step S62 is determined, and the process is returned to Step S54. On the other hand, even in a case where there is no print job that has not been processed in Step S60, the process is returned to Step S54.

In a case where any UI event occurs in Step S54, the process proceeds to Step S63, and it is determined whether or not color calibration (color matching) that is adjusted for reproducing output colors in an accurate and stable manner is performed. In a case where the color calibration is to be performed, the process proceeds to Step S64, and predetermined color calibration is performed, and then, the process is returned to Step S54. In Step S63, in a case where the color calibration is not to be performed, the process proceeds to Step S65, and it is determined whether or not various setting parameters are to be changed. Then, in a case where a predetermined parameter is to be changed, the process proceeds to Step S66, the parameter to be changed is stored, and then the process is returned to Step S54.

In a case where existing setting parameters are not to be changed in Step S65, the process proceeds to Step S67, it is determined whether or not the power of the image forming apparatus is to be turned off. In a case where the power is not to be turned off, the process is returned to Step S54. On the other hand, in a case where the power of the image forming apparatus is to be turned off in Step S67, the process proceeds to Step S68, various parameters of printing conditions are stored in the hard disk from the RAM 11 by the HDD 24, and then, the power of the image forming apparatus is turned off in Step S69.

According to this embodiment, in controlling the supply of toner to the developing container 9, for the purpose of stabilizing the developability and the transferability, a mechanism is included which adjusts the amount of charged toner to be constant. More specifically, in Step S59 illustrated in FIG. 3, the development contrast electric potential condition of an appropriate patch image that is a control image formed on the photosensitive drum 5 is determined. Here, the development contrast represents an electric potential difference between the electric potential of the image portion and a developing bias (a DC bias applied to the developing sleeve 18).

In this embodiment, information regarding the temperature of toner in the developing container 9 (inside the developing device) is detected by a temperature sensor 21 serving as a temperature detecting portion. Then, the CPU 2 also serving as a change portion (setting portion) corrects for the development contrast electric potential condition of an appropriate patch image serving as a control image in correspondence with a developing efficiency that changes according to the toner temperature, which is detected by the temperature sensor 21, in the developing container 9.

In other words, the CPU 2 serving as the setting portion sets development contrast that is an electric potential difference between the electric potential of the image portion at the time of forming the patch image serving as the control image and a DC bias applied to the developing device 8. Then, the CPU 2 sets the development contrast so as to be increased according to an increase in the toner temperature based on the detection result of the toner temperature, which is detected by the temperature sensor 21 serving as the temperature detecting portion, in the developing container 9. More specifically, in a case where the temperature of toner rises, as illustrate in FIG. 6A, the development efficiency decreases. In order to supplement this, the development contrast electric potential is raised by a level corresponding to the decreased developing efficiency.

Figure 6A:
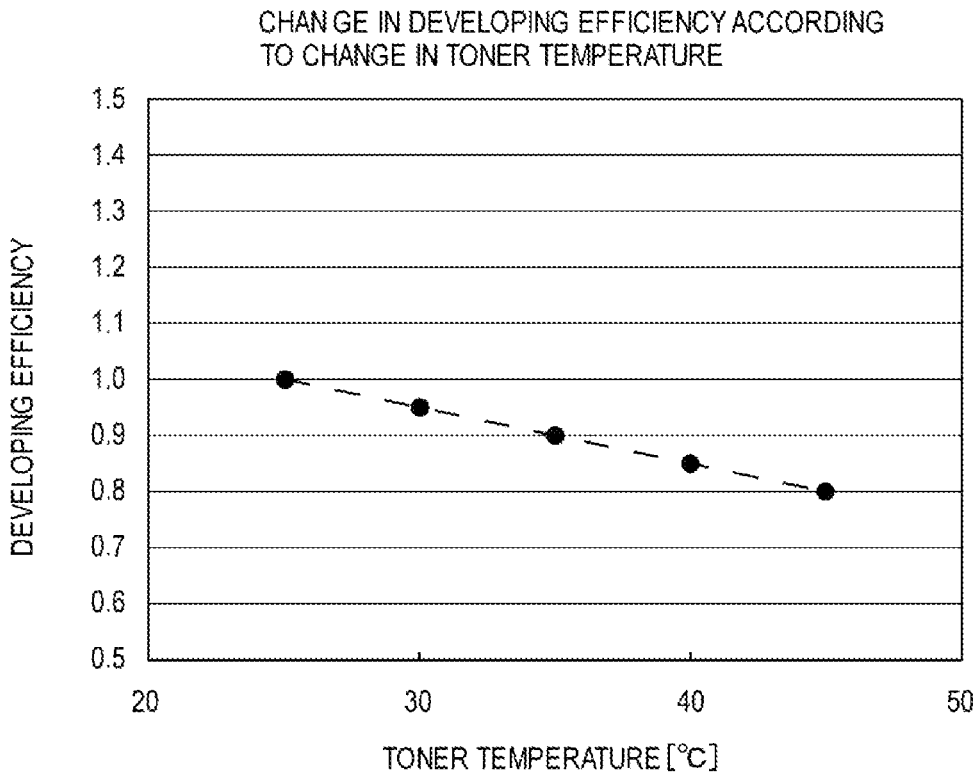
FIG. 6A is a diagram illustrating the developing efficiency at each temperature of toner in a developing portion according to the first embodiment.

More specifically, as illustrated in FIG. 6A, in a case where the developing efficiency decreases according to an increase in the temperature of toner, the development contrast that is an electric potential difference between the developing bias and the electric potential of the image portion is increased such that the same image density is acquired for the same toner specific charge. Alternatively, the target value of the density of the patch image is lowered so as not to detect a decrease in the image density due to the decrease in the developing efficiency. By configuring the density of the patch image to match the target value of the density using this method, the toner specific charge can be adjusted.

As illustrated in FIG. 6A, a case will be described in which the development contrast is to be increased in a case where the developing efficiency decreases due to an increase in the temperature of toner. The development contrast is multiplied by the reciprocal of the developing efficiency that is predicted based on the temperature of toner that is detected by the temperature sensor 21 serving as the temperature detecting portion or a predicted toner temperature. A latent image of a patch image serving as the control image is formed in the development contrast electric potential condition, and the density of the patch image acquired by developing the patch latent image is detected by the optical sensor 22 serving as the density detecting portion.

The optical sensor 22 serving as the density detecting portion detects the density of the patch image that is a control image formed on the photosensitive drum 5 serving as an image bearing member. The CPU 2 serving as the controller controls the toner supply amount (the amount of supply of developer) supplied to the inside of the developing container 9 of the developing device 8 based on the detection result of the density of the patch image that is the density of the control image detected by the optical sensor 22.

The amount of toner of the patch image is in proportion to the development contrast (an electric potential difference between the electric potential of the image portion and the development bias (a DC bias applied to the developing sleeve 18)) and the developing efficiency (the filling ratio of charged toner for the development contrast). On the other hand, the amount of toner of the patch image is inversely proportional to the specific charge of toner (electric charge per unit mass of toner). These can be represented in the following Expression 1.

$$\text{amount of toner} \propto \text{development contrast} \times \text{developing efficiency}/\text{specific charge of toner} \qquad \text{Expression 1}$$

In other words, even when the developing efficiency changes due to a change in the toner temperature, the development contrast is raised such that the amount of toner that is developed is constant. In other words, the numerator of Expression 1 is configured not to depend on a change in the temperature. Accordingly, by controlling the supply of toner such that the amount of toner that is developed is constant, the specific charge of toner (or the amount of charged toner) can be constant. In other words, by configuring the density of the patch image, which is acquired by reading out the amount of toner that is developed by using the optical sensor 22, to match the target value of the density, the amount of charged toner can be controlled to be constant.

Figure 4:
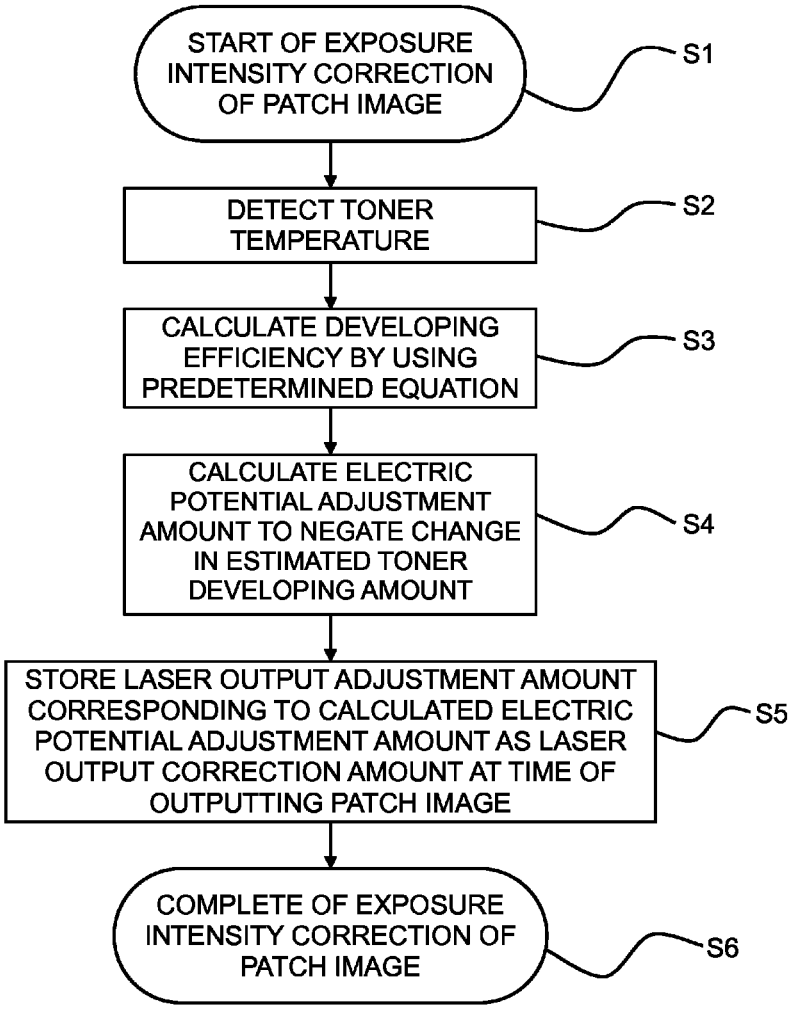
FIG. 4 is an operational flowchart of feedback control of a contrast electric potential condition at the time of forming a control image based on the temperature of toner, according to the first embodiment.

The toner supply amount to the developing container 9 is set through feedback control such that the density of an output image matches the target density based on the detection result of the density of the patch image (the amount of toner) detected by the optical sensor 22. FIG. 4 illustrates an operational flowchart of feedback control of a development contrast electric potential condition at the time of forming a patch image based on the toner temperature in the developing container 9.

According to a conventional technique, in Step S59 illustrated in FIG. 3, the supply of toner is controlled such that the density of the patch image is constant. In this embodiment, as illustrated in FIG. 4, the development contrast is controlled so as to supplement the developing efficiency that changes according to a change in the temperature of toner. Accordingly, as illustrated in FIG. 6A, even when the developing efficiency changes as in a case where the developing efficiency decreases due to an increase in the toner temperature, by configuring the image density to be constant, the toner specific charge is constant. According to this embodiment, not only the image density but also the specific charge of toner can be controlled to be constant.

The flowchart illustrated in FIG. 4 represents the flow of determining the patch image forming condition. The flowchart illustrated as Steps S1 to S6 shown in FIG. 4 is performed in Step S59 illustrated in FIG. 3 before a patch image is formed. A flowchart illustrated as Steps S11 to S20 shown in FIG. 5 relates to the determination of the toner supply adjustment amount in Step S59 illustrated in FIG. 3 and is performed after the flowchart illustrated as Steps S1 to S6 shown in FIG. 4.

First, in Step S1 illustrated in FIG. 4, when the correction for the exposure intensity of the laser driver 3 for the patch image serving as a control image is started, the toner temperature in the developing container 9 is detected by the temperature sensor 21 in Step S2. Next, in Step S3, the developing efficiency is calculated by using Expression 3 as will be described below.

Next, in Step S4, the CPU as a change portion calculates the adjustment amount of the development contrast electric potential by using Expression 2, as will be described below, so as to negate a change in the toner developing amount that is designated. Next, in Step S5, the CPU stores a laser output adjustment amount corresponding to the adjustment amount of the development contrast electric potential, which is calculated in Step S4, as a laser output correction amount at the time of outputting a patch image. Then, in Step S6, the correction of the patch image for the exposure intensity is completed.

Figure 5:
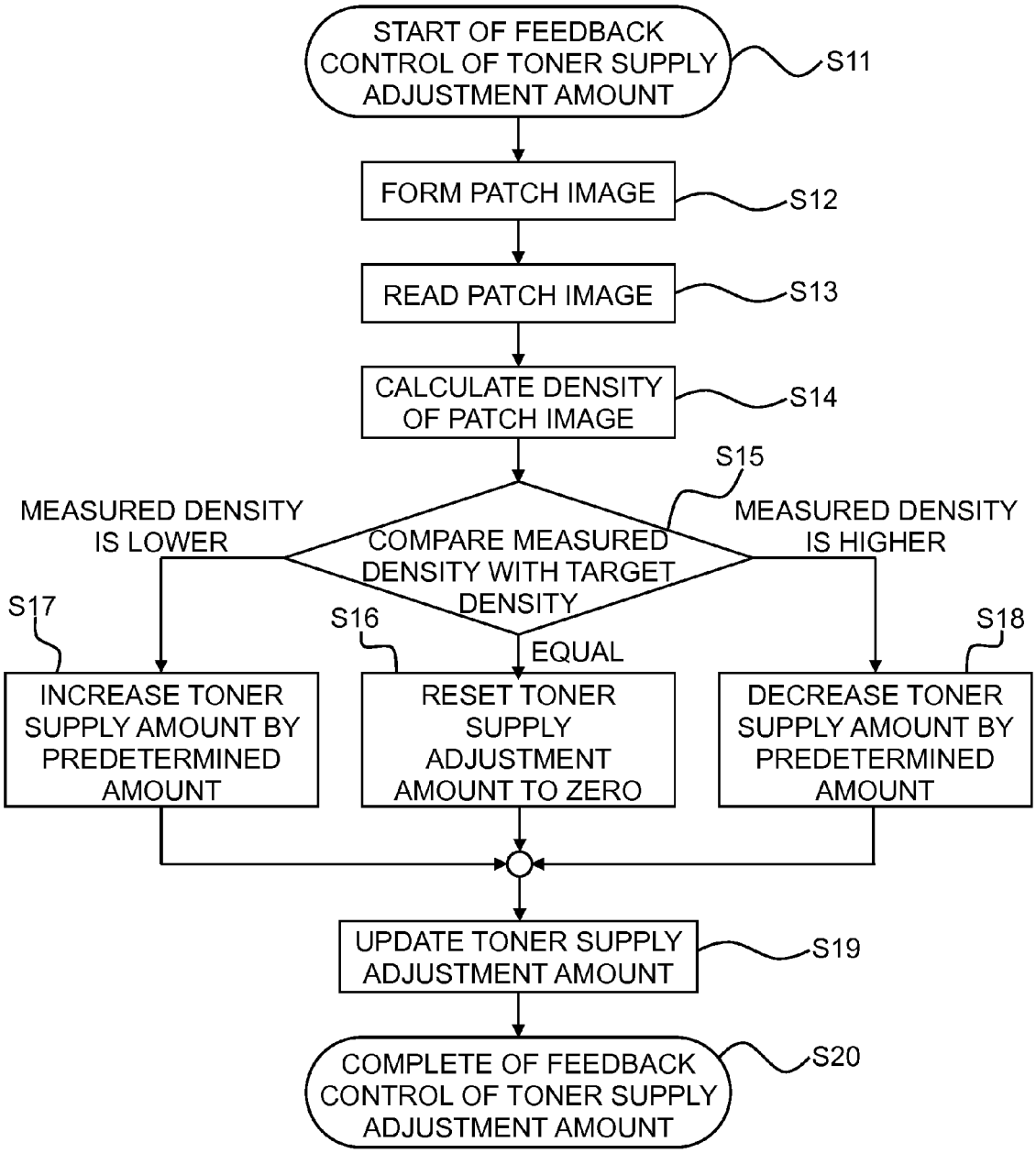
FIG. 5 is an operational flowchart of toner supply feedback control that is based on the measurement of the density of the control image in the condition of a corrected contrast electric potential, according to the first embodiment.

In addition, the operational flowchart of toner supply feedback control that is based on the formation of a patch image and the measurement of the density of the patch image in the condition of the corrected development contrast electric potential is illustrated in FIG. 5. In Step S11 illustrated in FIG. 5, when the feedback control of the toner supply adjustment amount is started, a patch image is formed on the photosensitive drum 5 in Step S12.

Then, the patch image formed in Step S12 is read by the optical sensor 22 in Step S13, and the density of the patch image is calculated in Step S14. Next, in Step S15, the density of the patch image that is calculated in Step S14 and a target density that is set in advance are compared with each other. When both the densities are the same, the process proceeds to Step S16, and the toner supply adjustment amount is reset to zero.

In Step S15, in a case where the density of the patch image that is calculated in Step S14 is lower than the target density set in advance, the process proceeds to Step S17, and the amount of the supply of toner is increased from a reference amount of the supply of toner, which is set in advance, by a predetermined amount based on a density difference between the density of the patch image and the target density. On the other hand, in a case where the density of the patch image that is calculated in Step S14 is higher than the target density set in advance, the process proceeds to Step S18, and the amount of the supply of toner is decreased from the reference amount of the supply of toner, which is set in advance, by a predetermined amount based on the difference between the density of the patch image and the target density.

Here, the reference amount of the supply of toner is the amount of toner that is equal to the amount of consumed toner that is estimated based on the output image data.

In Step S19, the toner supply adjustment amount that is reset or changed in Steps S16 to S18 is updated. Then, in Step S20, the feedback control of the toner supply adjustment amount is completed.

In FIG. 4, an example has been described in which the development contrast is changed by correcting the exposure intensity of the laser driver 3 for the patch image, and accordingly, the amount of charged toner is controlled to be constant. Alternatively, the amount of charged toner can be controlled to be constant by changing the target value of the density of the patch image. In other words, as illustrated in FIG. 6A, in a case where the developing efficiency decreases due to an increase in the toner temperature, the target value of the density of the patch image is lowered so as to negate a decrease in the image density due to the decrease in the developing efficiency.

According to such a method, although the specific charge of toner can be adjusted by configuring the density of the patch image to match the target value of the density, the flow is slightly different from the flow illustrated in FIG. 3. In this case, in Step S59 illustrated in FIG. 3, before the read value of the density of the patch image and the density target value of the density of the patch image are compared with each other (see Step S15 illustrated in FIG. 5) in Step S59 illustrated in FIG. 3, the target value of the density of the patch image is changed based on the detection result of the toner temperature. At this time, the flow illustrated in FIG. 4 is not performed. More specifically, as illustrated in FIG. 6A, in a case where the developing efficiency decreases due to an increase in the toner temperature, the target value of the density of the patch image is lowered by a density value corresponding to the toner developing amount that is decreased due to the decrease in the developing efficiency. The flow other than that is the same as the flow illustrated in FIG. 3.

In the method in which the specific charge of toner is controlled to be constant by controlling the patch image formation condition, the CPU 2 serving as a controller sets a density target value as an image formation condition at the time of forming a patch image serving as a control image based on the detection result acquired by the temperature sensor 21 serving as a temperature detecting portion. Then, the amount of the supply of toner to the inside of the developing container 9 serving as a developing device is set based on the detection result acquired by the optical sensor 22 serving as a density detecting portion.

In addition, in the developing container 9, the T/D ratio detecting sensor 16 is disposed which is used for measuring the ratio between the toner and the magnetic carrier in the developing container 9. The T/D ratio detecting sensor 16*a* may be configured by an inductance sensor that detects the permeability of the developer in the developing container 9. By measuring the permeability of the developer by using the inductance sensor, the toner density (the ratio of the weight (T) of non-magnetic toner to a sum weight (D) of the magnetic carrier and the non-magnetic toner: hereinafter, referred to as a "T/D ratio") in the developer in the developing container 9 can be measured.

In addition to the control of the amount of the supply of toner, which is illustrated in FIG. 5, in order to prevent the scattering of the toner and the adherence of the magnetic carrier to the photosensitive drum 5, control is performed based on the value of the T/D ratio detecting sensor 16 such that the T/D ratio is within a predetermined range, in other words, within the upper and lower limit values of the T/D value. In addition, the output value of the T/D ratio detecting sensor 16 is received by the CPU 2 through an analog/digital (A/D) converter 17 at necessary timing.

In the configuration in which the density of the patch image, which is detected by the optical sensor 22, is controlled to be fed back to the amount of the supply of toner, the T/D ratio is changed by controlling the amount of supply of the toner such that the toner developing amount is constant for an electrostatic latent image of a predetermined electric potential on the photosensitive drum 5.

Here, in order to describe the advantages of this embodiment, a comparative example will be described in a case where the detection result of the toner temperature in the developing container 9, which is detected by the temperature sensor 21, is not controlled to be fed back to the patch image forming electric potential.

In a case where the developing efficiency is constant, the toner temperature in the developing container 9 is not controlled to be fed back to the patch image forming electric potential, and the T/D ratio is changed by controlling the amount of the supply of toner. As a result, when the reference value of the density of the patch image used for controlling the supply of toner and a read value (density) of a patch image formed on the photosensitive drum 5, which is detected by the optical sensor 22, are controlled to coincide with each other, the amount of charged toner reaches a desired target amount of charged toner. In other words, the amount of charged toner can be maintained to be constant through the feedback control of the supply of toner based on the formation of the patch image in a predetermined electric potential condition.

However, by performing only the adjustment of the amount of charged toner through the control of the supply of toner based on the density of the patch image in the predetermined electric potential condition, in a case where the developing efficiency changes, there is a problem in that the control operation of causing the amount of charged toner to be constant is interfered.

In a control mechanism for stabilizing the density of the output image through adjusting the toner supply amount based on the output result of the density of the patch image, the density of the patch image is controlled to be measured, and various adjustments are controlled to be performed. In such a case, it cannot be distinguished when the density of the patch image changes between a case where the amount of charged toner changes and a case where the developing efficiency changes. Accordingly, as illustrated in FIG. 6A, in a case where the developing efficiency changes according to the toner temperature, the density of the patch image changes even when the amount of charged toner is the target value. Even in such a situation, since the toner supply amount is controlled to be the amount of charged toner at which the density of the patch image coincides with the target density, the amount of charged toner deviates from the target value.

Hereinafter, a characteristic control part of this embodiment will be described. According to this embodiment, as illustrated in FIG. 6A, a mechanism is included which controls the amount of charged toner to be constant even in a case where a change in the developing efficiency caused by a change in the toner temperature occurs. In the image forming apparatus, a change in the developing efficiency from a reference value is estimated based on the toner temperature, and the image exposure intensity at the time of outputting an image, which is emitted from the laser diode (LD: semiconductor laser) of the laser driver 3, is controlled so as to negate a change in the density which corresponds to the change.

In this embodiment, as a first method, as illustrated in FIG. 6A, in a case where the developing efficiency changes due to a change in the toner temperature, the image forming condition at the time of forming a patch image serving as a control image is controlled based on the detection result of the temperature sensor 21 serving as a temperature detecting portion. As an example of such a method, as the latent image condition at the time of forming the patch image, the development contrast is controlled. In this embodiment, the image exposure intensity at the time of outputting the image, which is emitted from the LD (semiconductor laser) of the laser driver 3 by way of changing the development contrast is controlled.

In addition, also for a normal image, as illustrated in FIG. 6A, in order to prevent a change in the image density due to a change in the developing efficiency that is caused by a change in the toner temperature, the image exposure intensity at the time of outputting the image, which is emitted from the LD (semiconductor laser) of the laser driver 3, is controlled. Here, the method of changing the development contrast is not limited to the method of correcting for the output of the laser driver 3, and for example, a method may be employed in which the development DC bias applied to the developing device 8 is changed.

Here, the time of outputting an image includes the time of forming a patch image and the time of forming a normal image. By adjusting the density of the patch image by controlling the development contrast at the time of forming the patch image, the specific charge of toner can be adjusted. In addition, by controlling the development contrast at the time of forming a normal image, the density of the output image can be adjusted.

As a second method replacing the first method, as illustrated in FIG. 6A, in a case where the developing efficiency changes due to a change in the toner temperature, the target value of the density of the patch image serving as a control image is controlled by the CPU 2 serving also as a setting portion based on the detection result acquired by the temperature sensor 21 serving as a temperature detecting portion. In this case, the image exposure intensity at the time of outputting an image, which is emitted from the LD (semiconductor laser) of the laser driver 3 at the time of forming the patch image, is not changed.

However, at the time of forming a normal image, the image exposure intensity at the time of outputting an image, which is emitted from the LD (semiconductor laser) of the laser driver 3, is controlled. According to such a second method, the specific charge of toner is controlled to be constant by changing the target value of the density of the patch image, and, by changing the image exposure intensity at the time of outputting an image, which is emitted from the LD (semiconductor laser) of the laser driver 3 at the time of forming a normal image, the image density is controlled to be constant.

In this embodiment, the emission intensity of the LD (semiconductor laser) is adjusted such that the development contrast electric potential satisfies the following Expression 2. In addition, in the following Expression 2, the development contrast electric potential at a reference temperature is a development contrast electric potential that is appropriately determined at a predetermined temperature used as a reference. Furthermore, a correction rate of the development contrast electric potential has a function of correcting for the toner developing amount due to a change in the development efficiency that is caused by the toner temperature. In addition, an appropriate correction rate of the development contrast electric potential is calculated and determined by using Expression 4, which will be described below, based on the detection results acquired by the temperature sensor 21 disposed in each developing container 9.

Here, in the following Expression 2, the time of outputting an image includes the time of forming a patch image and the time of forming a normal image.

{development contrast electric potential at the time of outputting image}={development contrast electric potential at reference temperature}×{correction rate of development contrast electric potential} Expression 2

The correction rate of the development contrast electric potential represented in Expression 2 can be acquired based on the development efficiency according to the toner temperature represented in the following Expression 3 and the correction rate of the development contrast electric potential according to the development efficiency represented in the following Expression 4. A linearly-approximated expression of the development efficiency according to the toner temperature is represented in the following Expression 3. In the following Expression 3 presented below, T denotes the toner temperature, and two parameters including $\alpha$ and $\beta$ are parameters set in advance according to the temperature characteristic of the developer within a use temperature range of the image forming apparatus. Here, $\alpha$ denotes the angle of the change in the developing efficiency, $\beta$ denotes a temperature angle that is used as a reference within the use temperature range, and the developing efficiency at $\{T=\beta\}$ is "1".

$$\text{developing efficiency}=1-\alpha\times(T-\beta) \quad \text{Expression 3}$$

FIG. 6A illustrates the developing efficiency at each temperature of developer used in this embodiment. Based on FIG. 6A, in the developer used in this embodiment, the slope of a straight line represented in FIG. 6A, which is the temperature angle of the change in the developing efficiency, has a change in the development efficiency of 0.1 between the toner temperatures of 30° C. and 40° C. illustrated in FIG. 6A. Accordingly, as 0.1/10 [° C.], $\alpha$=0.01/[° C.] is acquired, and the reference temperature $\beta$=25° C. within the use temperature range.

The correction rate of the development contrast electric potential of the patch image serving as a control image according to the development efficiency is represented in the following Expression 4.

correction rate of development contrast electric potential=1/development efficiency Expression 4

Figure 6B:
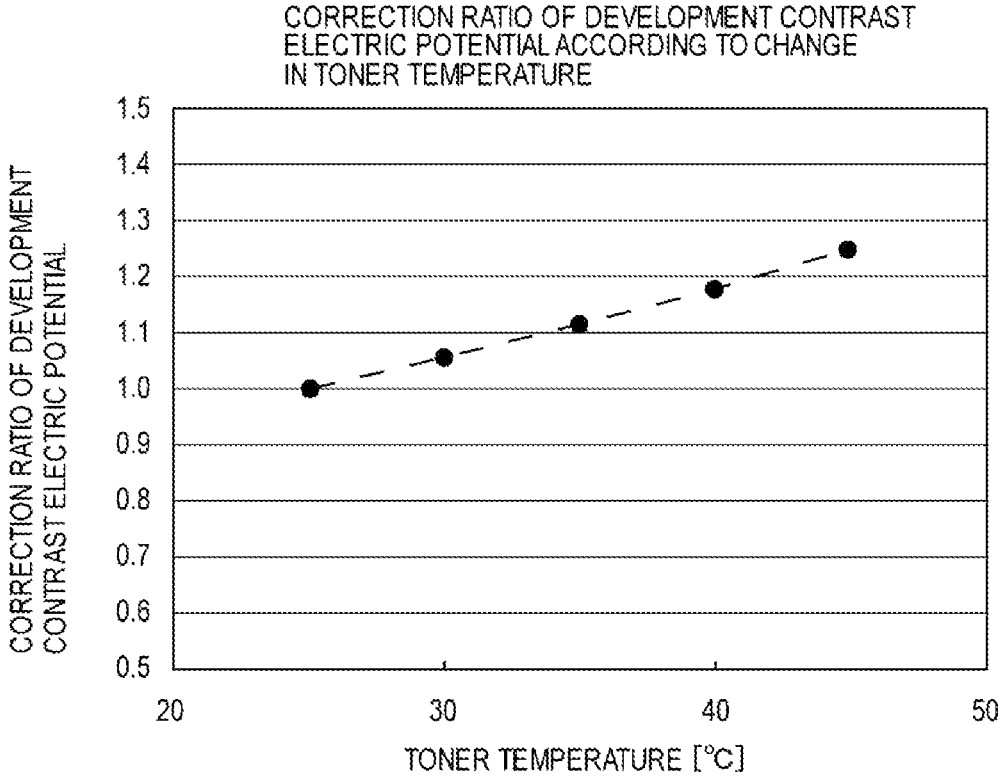
FIG. 6B is a diagram illustrating the correction rate of the development contrast electric potential at each toner temperature in the developing portion according to the first embodiment.

Expression 4 illustrates the correction of the development contrast electric potential that is performed for suppressing a change in the toner developing amount when the development efficiency changes. FIG. 6B illustrates the correction rate of the development contrast electric potential at each temperature, which is calculated by using Expressions 2 to 4 described above, in this embodiment.

Figure 2:
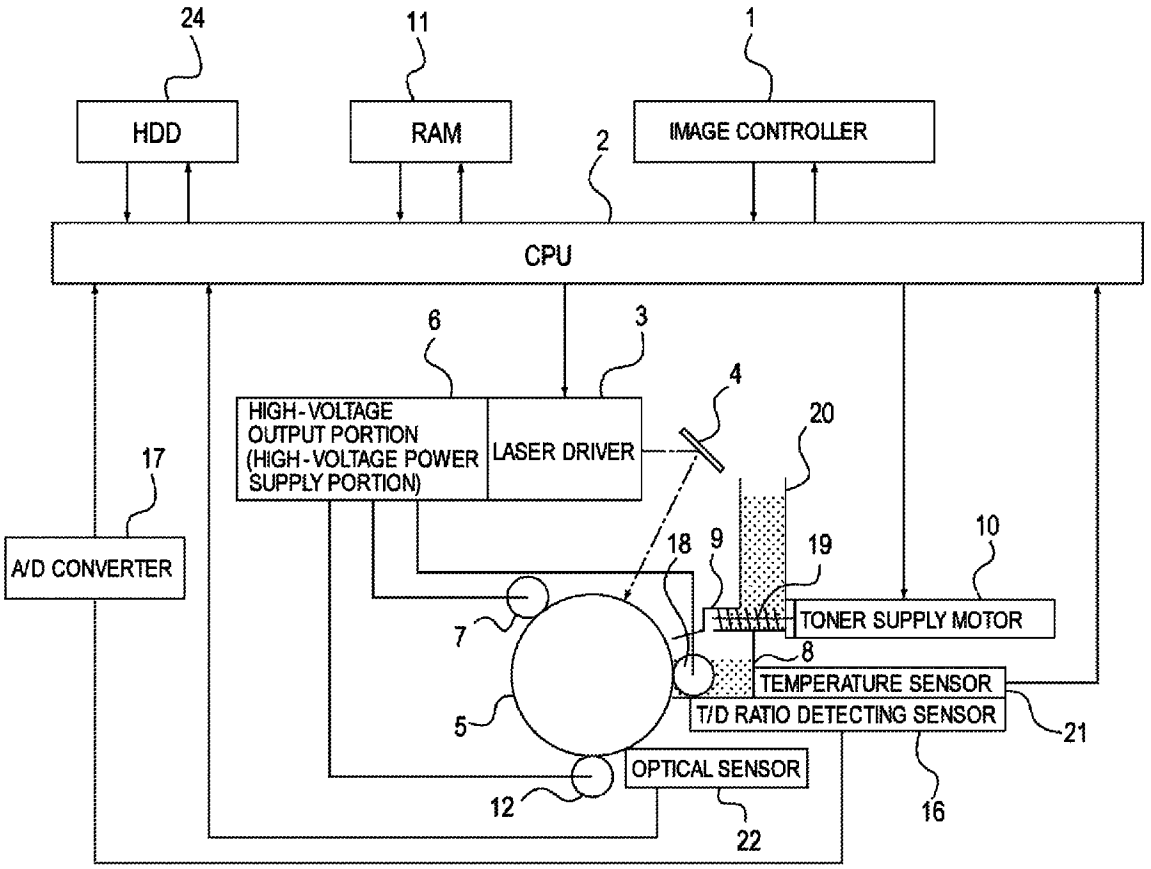
FIG. 2 is an enlarged diagram of a part of FIG. 1.

The block diagram of a control system for predicting the development efficiency based on the detection of the toner temperature, which is detected by the temperature sensor 21 disposed in the developing container 9, controlling the exposure intensity, and a toner supply operation is illustrated in FIG. 2. FIG. 2 illustrates a part of the configuration of the image forming apparatus illustrated in FIG. 1. In FIG. 2, the CPU 2 reads the temperature value of the toner that is detected by the temperature sensor 21 included in the developing container 9 (in a developing portion). The CPU 2 predicts a change in the developing efficiency based on Expression 3 using the toner temperature and calculates the correction amount of the development contrast electric potential based on Expression 4. Then, the CPU 2 performs feedback control of the image exposure intensity emitted from the LD (semiconductor laser) disposed in the laser driver 3 based on Expression 2 at the time of forming an image.

When a patch image is formed, the density of the developed toner after development is detected by the optical sensor 22, and a value detected by the optical sensor 22 is read by the CPU 2. The CPU 2 compares the value detected by the optical sensor 22 and a target value set in advance with each other and sets the amount of supply of the toner to the inside of the developing container 9 by performing feedback control of the toner supply motor 10 based on the comparison result.

In other words, the CPU 2 serving as a controller controls the toner supply amount (developer supply amount) based on the detection result of the density of the patch image, which is the density of the control image detected by the optical sensor 22 serving as a density detecting portion, and the target value of the density of the patch image. In the second method replacing the first method, the CPU 2 also serving as a setting portion sets the target value of the density of the patch image based on the detection result of the toner temperature detected by the temperature sensor 21 serving as a temperature detecting portion such that the target value of the density of the patch image is decreased according to an increase in the toner temperature. The patch image is controlled in the first method, and the target density of the patch image is changed in the second method.

When a normal image is output, as illustrated in FIG. 1, toner images developed on the photosensitive drums 5 are transferred onto the intermediate transfer belt 13 by the primary transfer unit 12 in an overlapping manner. Furthermore, the toner images transferred onto the intermediate transfer belt 13 are secondarily transferred onto the recording material 15 by the secondary transfer unit 14. The recording material 15 onto which the toner images are transferred is conveyed to a fixing device 23 by a conveying roller not illustrated in the figure, and is heated and pressed by the fixing device 23 so as to permanently fix the toner images to the recording material 15, and the recording material 15 is conveyed to the outside of the image forming apparatus.

In this embodiment, in order to allow the amount of toner developed at the time of forming a patch image serving as a control image to be constant, the patch image serving as the control image is formed based on the detection result acquired by the temperature sensor 21 that is disposed in the developing container 9 and serves as a temperature detecting portion. As an example of the electric potential condition at that time, the exposure intensity of the laser driver 3 at the time of forming the latent image is changed according to the toner temperature in the developing container 9. By performing a control process other than that in which the toner developing amount is constant, the same advantages are acquired. For example, by employing a configuration in which feedback control of the DC component of the development bias voltage applied to the developing sleeve 18 serving as a developer bearing member is performed, and the development contrast electric potential is corrected, the same advantages are acquired.

In addition, instead of configuring the toner developing amount of the patch image to be constant, by changing the target value of the toner developing amount that is determined based on the density of the patch image according to the toner temperature, the same advantages are acquired. This is the second method, and, in such a case, a value acquired by multiplying the reference target amount of toner by the developing efficiency is set as a new target amount of toner.

As above, according to this embodiment, the CPU as a setting portion (change portion) adjusts and sets the electric potential condition (the exposure intensity at the time of forming a latent image or the charging bias voltage) at the time of forming the patch image serving as a control image based on the detection result of the toner temperature in the developing container 9 which is detected by the temperature sensor 21. Then, by performing the feedback control such that the patch image has a constant density (the toner developing amount), the control operation is performed such that the amount of charged toner is the target value as a constant value. In addition, in order to supply the toner developing amount due to a change in the developing efficiency that is caused by the toner temperature, the image exposure intensity used for an output image is controlled. Accordingly, both the stability of the amount of the charged toner and the stability of the amount of developed toner for the output image are realized, and therefore, the stability of the image density and the image quality can be acquired.

Second Embodiment

In this embodiment, in addition to the above-described configuration of the first embodiment, the temperature of toner in each developing container 9 is detected or predicted by a temperature sensor 21 that is included in the developing container 9 and serves as a temperature detecting portion. In the aspect of this embodiment, a development bias voltage at the time of development as a development condition at the time of forming an image is changed and set by a CPU 2 serving as a controller based on the result of the detection or the prediction.

In a case where a decrease in the developing efficiency occurs due to a change in the toner temperature in the developing container 9, toner having a large amount of electric charge per unit mass is difficult to develop. In addition, there is a case where a phenomenon called "selective development" may occur in which only toner having a small amount of electric charge is developed, and there is a problem in that toner having a charging amount, which is not developed, is accumulated in the developing container 9. The reason for this is understood that the toner parting properties between the toner and the carrier changes due to a change in the viscosity of the surface of the toner depending on the temperature.

Figure 7A:
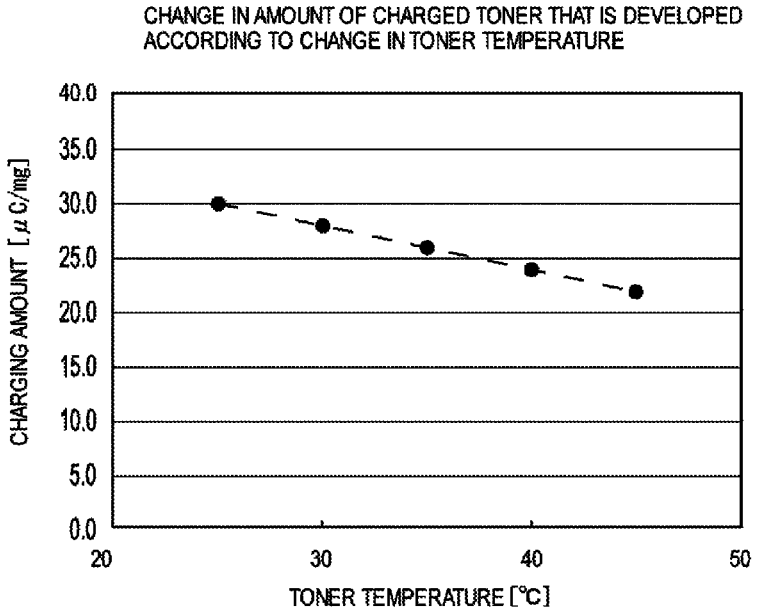
FIG. 7A is a diagram illustrating the relation between the temperature of toner and the amount of charged toner that is developed according to a second embodiment in a case where a toner charging amount distribution inside a developing portion is the same.

The relation between the temperature of toner and the amount of charged toner that is developed in a case where the toner charging amount distribution in the developing container 9 is the same (the average toner charging amount per unit mass is 30 [μC/mg]) in this embodiment is illustrated in FIG. 7A. In FIG. 7A, the vertical axis represents the average charging amount of the developing container 9. As illustrated in FIG. 7A, as the toner temperature in the developing container 9 rises, the charging amount of toner that is developed decreases. Accordingly, the developing efficiency decreases, and, in a case where a large amount of toner is consumed in the situation in which the average charging amount (the toner charging amount as a target) of the toner in the developing container 9 and the charging amount of the toner to be developed deviate from each other, the distribution of the toner charging amount in the developing container 9 is biased.

In this embodiment, a patch image corrected based on the toner temperature in the developing container 9, which is detected by the temperature sensor 21, and a blank length (applied time) that is the length of a DC component of the development bias voltage in a normal image are adjusted and set. Then, by performing feedback control such that the charging amount of toner that is developed is not biased by changing the force applied to the toner at the time of the development, the toner charging amount distribution in the developing container 9 is appropriately maintained.

Figure 7B:
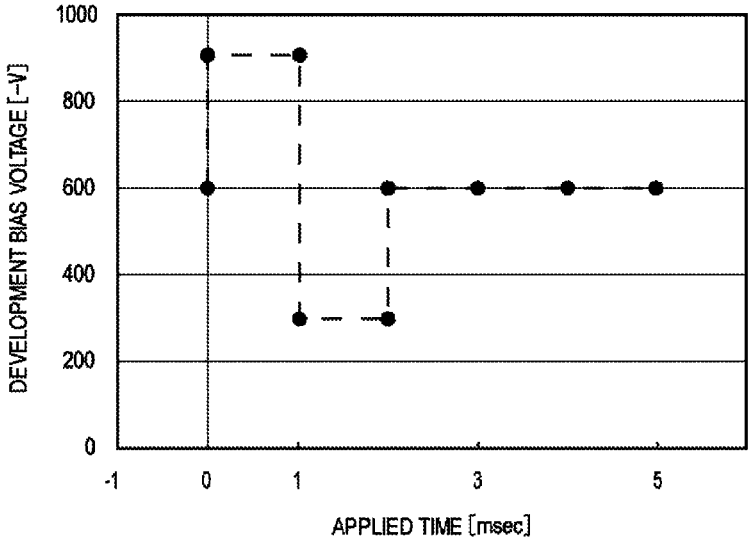
FIG. 7B is a diagram illustrating the waveform of a development bias voltage that is applied in a normal developing operation.

In this embodiment, when a normal image is developed, a development bias voltage as illustrated in FIG. 7B is applied. As illustrated in FIG. 7B, an AC bias voltage and a DC bias voltage are applied in an overlapping manner between 0 [msec] and 2 [msec] after the start of applying the development bias voltage (second period). Thereafter, only a DC component is applied between 2 [msec] and 5 [msec] (first period). The development bias voltage having this waveform is periodically applied at the time of development until the development is completed. In other words, the first period in which only a DC bias is applied and the second period in which an AC bias is applied are alternated in the developing device 8.

Figure 8:
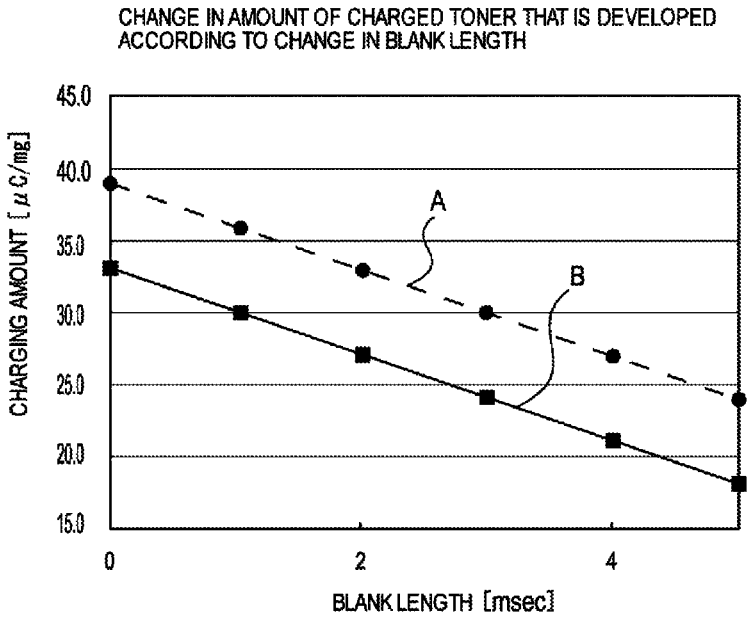
FIG. 8 is a diagram illustrating the relation between a blank length and the amount of charged toner that is developed according to the second embodiment in a case where a toner charging amount distribution inside the developing portion is the same.

FIG. 8 illustrates the relation between the blank length (applied time) that is the length of the DC component of the development bias voltage and the amount of charged toner that is developed in a case where the toner charging amount distribution in the developing container 9 is the same (the average of the toner charging amount per unit mass is 30 [μC/mg]). In FIG. 8, the vertical axis represents the average charging amount in the developing container 9. A broken line A illustrated in FIG. 8 illustrates a case where the toner temperature in the developing container 9 is 25° C., and a solid line B illustrates a case where the toner temperature in the developing container 9 is 40° C.

At each temperature illustrated in FIG. 8, as the blank length (applied time) that is the length of the DC component of the development bias voltage is decreased, the amount of charged toner that is developed increases. In this embodiment, by setting the blank length to 3 [msec] in a case where the toner temperature in the developing container 9 is 25° C. and setting the blank length to 1 [msec] in a case where the toner temperature is 40° C., the amounts of charged toner that is developed at 25° C. and 40° C. are controlled to be constant.

In other words, the CPU 2 serving as a controller controls the first period based on the detection result of the toner temperature in the developing container 9 which is detected by the temperature sensor 21 serving as a temperature detecting portion. In other words, in a case where the toner temperature rises, the first period is shortened in which only a DC bias is applied as is illustrated in 2 [msec] to 3 [msec] from the applied time illustrated in FIG. 8.

When a change in the amount (average) of charged toner that is developed according to the toner temperature in the developing container 9 is formed as an expression through linear approximation, the following Expression 4 is formed. Here, T denotes the toner temperature in the developing container 9, two parameters including "a" and "b" are parameters that are determined according to the temperature characteristic of the toner within the use temperature range of the image forming apparatus, a denotes the temperature angle of the change in the amount of charged toner after the development, and b denotes a temperature that is used as a reference within the use temperature range.

$$\{\text{average amount of charged toner after development}\}=\{\text{average amount of charged toner in developing container}\}\times\{1-a\times(T-b)\} \quad \text{Expression 5}$$

FIG. 7A illustrates the amount of charged toner, which is used in this embodiment, after development at each temperature. Based on FIG. 7A, in the toner used in this embodiment, the temperature angle of the change in the amount of charged toner after the development a=0.0133/° C., and the reference temperature b=25° C. The change in the amount of charged toner that is developed according to the blank length at each temperature is represented by the following Expression 6. Here, t is a blank length (applied time) that is the length of the DC component of the development bias voltage. In addition, two parameters including "c" and "d" are parameters that are determined according to the temperature characteristic of the toner within the use temperature range, c denotes the blank length angle of the change in the amount of charged toner after the development, and d denotes a blank length that is used as a reference within the use temperature range.

$$\{\text{average amount of charged toner after development}\}=\{\text{average amount of charged toner in developing container}\}\times\{1-c\times(t-d)\} \quad \text{Expression 6}$$

FIG. 8 illustrates the amount of charged toner, which is used in this embodiment, after development in the blank length at each temperature. Based on FIG. 8, in this embodiment, the blank length angle of the change in the amount of charged toner after development c=0.01/[msec], and the reference blank length d=3 [msec].

Based on the above Expressions 5 and 6, the average amount of charged toner after development is represented by the following Expression 7.

$$\{\text{average amount of charged toner after development}\}=\{\text{average amount of charged toner in developing container}\}\times\{1-a\times(T-b)\}\times\{1-c\times(t-d)\} \quad \text{Expression 7}$$

A blank length t for which the average amount of charged toner in the developing container 9 at each temperature and the average amount of charged toner after the development coincide with each other is acquired by using the following Expression 8 based on the above Expression 7.

$$1=\{1\times a\times(T-b)\}\times\{1-c\times(t-d)\} \quad \text{Expression 8}$$

Figure 9:
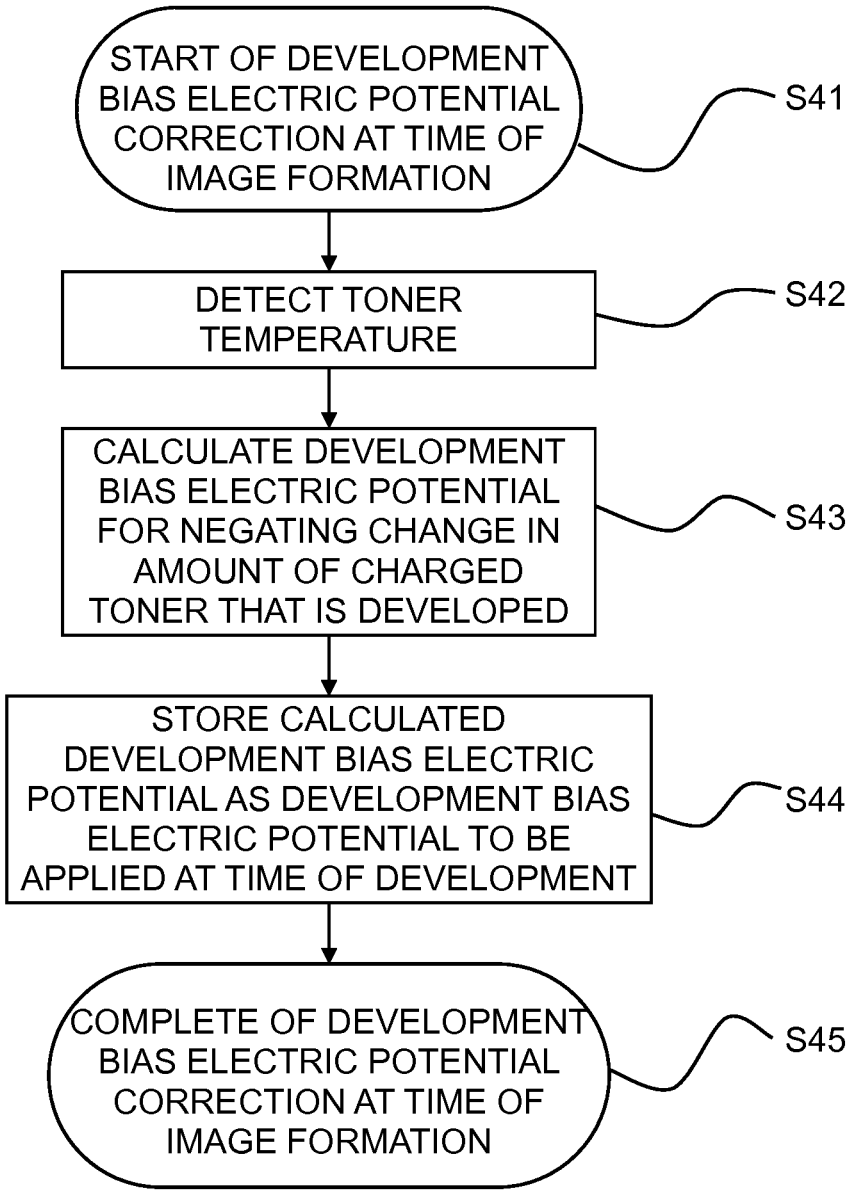
FIG. 9 is a flowchart illustrating the appearance of controlling the correction of the waveform of a development bias voltage based on the detection result of the temperature of toner, according to the second embodiment.

Based on the detection result of the toner temperature in the developing container 9, which is detected by the temperature sensor 21, a flowchart in a case where feedback control of the development bias voltage waveform as an example of the development condition at the time of image formation is illustrated in FIG. 9, and the configuration of the control system thereof will be described with reference to FIG. 2. In this embodiment, the CPU 2 serving as a controller reads a temperature value detected by the temperature sensor 21 included in the developing container 9, calculates a blank length that is the DC component length of an appropriate development bias voltage, and performs feedback control of the calculated blank length to the high-voltage output portion 6. In this embodiment, the CPU 2 serving as a controller decreases the length of the DC component of the development bias voltage at the time of image formation based on the detection result of the temperature sensor 21 in a case where the toner temperature rises.

In other words, in Step S41 illustrated in FIG. 9, when a control operation of correcting the development bias electric potential at the time of image formation is started, the toner temperature in the developing container 9 is detected by the temperature sensor 21 in Step S42. Next, in Step S43, a development bias electric potential used for negating a variation in the amount of charged toner that is developed is calculated. Next, in Step S44, the calculated development bias electric potential is stored as a development bias electric potential to be applied at the time of development. Then, in Step S45, the control operation of correcting the development bias electric potential at the time of image formation is completed.

In this embodiment, in order to form the amount of charged toner that is developed to be constant, although the blank length that is the length of the DC component of the development bias voltage is changed according to the toner temperature in the developing container 9, in a case where a control operation of changing the amount of charged toner that is developed is performed, the same advantages are acquired. For example, by controlling the peak-to-peak voltage of the AC component of the development bias voltage, the applied time of the AC component, the same advantages are acquired.

As above, in this embodiment, the development condition at the time of image formation is adjusted and set based on the toner temperature in the developing container 9, and feedback control is performed such that the amount of charged toner that is developed is not biased. Accordingly, the developing efficiency changing according to the toner temperature is controlled to be supplemented while the toner charging amount distribution in the developing container 9 is appropriately maintained. Accordingly, the toner charging amount distribution in the developing container 9 and the amount of charged toner of an output image are maintained in excellent states, whereby an excellent output image can be secured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-117427, filed May 25, 2011, which is hereby incorporated by reference herein in its entirety.

What is claimed is:

1. An image forming apparatus comprising:

an image bearing member on which an electrostatic latent image is formed;

a developing device that develops the electrostatic latent image formed on the image bearing member by using developer;

a temperature detecting portion that detects information regarding the temperature of the developer in the developing device;

a density detecting portion that detects a density of a control image formed on the image bearing member;

a controller that controls the amount of the developer supplied to the developing device based on the detection result of the density of the control image and a target value; and a change portion that changes an electric potential difference between an electric potential of the electrostatic latent image of the control image and a DC bias applied to the developing device or the target value so as to suppress a variation in the amount of charged developer in the developing device, based on the detection result acquired by the temperature detecting portion, wherein a first period during which only a DC bias is applied and a second period during which an AC bias is applied are alternated in the developing device, and the controller decreases the first period in a case where the temperature of the developer rises based on the detection result acquired by the temperature detecting portion.

2. The image forming apparatus according to claim 1, wherein the change portion changes the electric potential difference such that the electric potential difference increases according to an increase in the temperature of the developer based on the detection result acquired by the temperature detecting portion.

3. The image forming apparatus according to claim 2, wherein the change portion changes the electric potential difference such that the electric potential difference increases according to an increase in the temperature of the developer in the developing device so as to suppress a variation in the amount of developer in the developing device.

4. An image forming apparatus comprising:

an image bearing member on which an electrostatic latent image is formed;

a developing device that develops the electrostatic latent image formed on the image bearing member by using developer;

a temperature detecting portion that detects information regarding the temperature of the developer in the developing device;

a density detecting portion that detects a density of a control image formed on the image bearing member;

a controller that controls the amount of the developer supplied to the developing device based on the detection result of the density of the control image and a target value based on the detection result acquired by the temperature detecting portion;

a biasing device that applies bias to the developing device, the biasing device able to apply bias in which a first period applying a bias of only a DC component and a second period applying a bias overlapping the DC component and an AC component after the first period are alternated, wherein the controller sets a length of the first period at a first length when temperature detected by the temperature detecting portion is equal or higher than a predetermined temperature and sets a length of the first period at a second length which is longer than the first length when the temperature detected by the temperature detecting portion is lower than the predetermined temperature.

* * * * *